US006305288B1

(12) United States Patent
Nilsson et al.

(10) Patent No.: US 6,305,288 B1
(45) Date of Patent: Oct. 23, 2001

(54) PROPELLANT CHARGE MODULE

(75) Inventors: Neile Nilsson, Karlskoga; Larseric Larsson, Degerfors; Anders Hafstrand, Karlskoga, all of (SE)

(73) Assignee: Bofors Defence Aktiebolag, Karlskoga (SE)

( * ) Notice: Subject to any disclaimer, the term of this patent is extended or adjusted under 35 U.S.C. 154(b) by 0 days.

(21) Appl. No.: 09/485,347

(22) PCT Filed: Aug. 5, 1998

(86) PCT No.: PCT/SE98/01436

§ 371 Date: Mar. 14, 2000

§ 102(e) Date: Mar. 14, 2000

(87) PCT Pub. No.: WO99/09369

PCT Pub. Date: Feb. 25, 1999

(30) Foreign Application Priority Data

Aug. 14, 1997 (SE) ..... 9702949

(51) Int. Cl.[7] ..... C06D 5/06; F42B 12/02; F42B 12/20

(52) U.S. Cl. ..... 102/288; 102/478; 102/490

(58) Field of Search ..... 102/282, 288, 102/478, 490

(56) References Cited

U.S. PATENT DOCUMENTS

| | | | | |
|---|---|---|---|---|
| 4,314,509 | * | 2/1982 | Dalet | 102/288 |
| 4,408,534 | * | 10/1983 | Araki et al. | 102/288 |
| 4,702,167 | | 10/1987 | Reinelt et al. | 102/282 |
| 5,101,730 | | 4/1992 | Bender et al. | 102/288 |
| 5,282,423 | * | 2/1994 | Sikorski et al. | 102/282 |
| 5,454,323 | * | 10/1995 | Conil | 102/282 |
| 5,551,343 | | 9/1996 | Hock et al. | 102/288 |
| 5,578,787 | | 11/1996 | Kobari et al. | 102/288 |
| 5,670,735 | | 9/1997 | Ortmann et al. | 102/202 |
| 5,726,379 | * | 3/1998 | Kotas et al. | 102/282 |
| 5,747,723 | * | 5/1998 | Buckalew et al. | 102/282 |

FOREIGN PATENT DOCUMENTS 44 45 991 A1 6/1996 (DE) .

* cited by examiner

*Primary Examiner*—Peter A. Nelson
(74) *Attorney, Agent, or Firm*—Connolly Bove Lodge & Hutz, LLP

(57) ABSTRACT

The present invention relates to a propellant charge module for artillery guns, of the type which is usually referred to by the term "modular charges" (1). A special feature of this type is that, in an otherwise empty pyrophoric relay tube (10) arranged axially in the longitudinal direction of the charge, it has a firing charge which is made up of a plurality of successive powder rings (14), the different ring-shaped parts of this firing charge having distancing members (16) which are directed towards each other and give rise to narrow ignition gaps (18) between them.

8 Claims, 2 Drawing Sheets

PROPELLANT CHARGE MODULE

Figure 2:
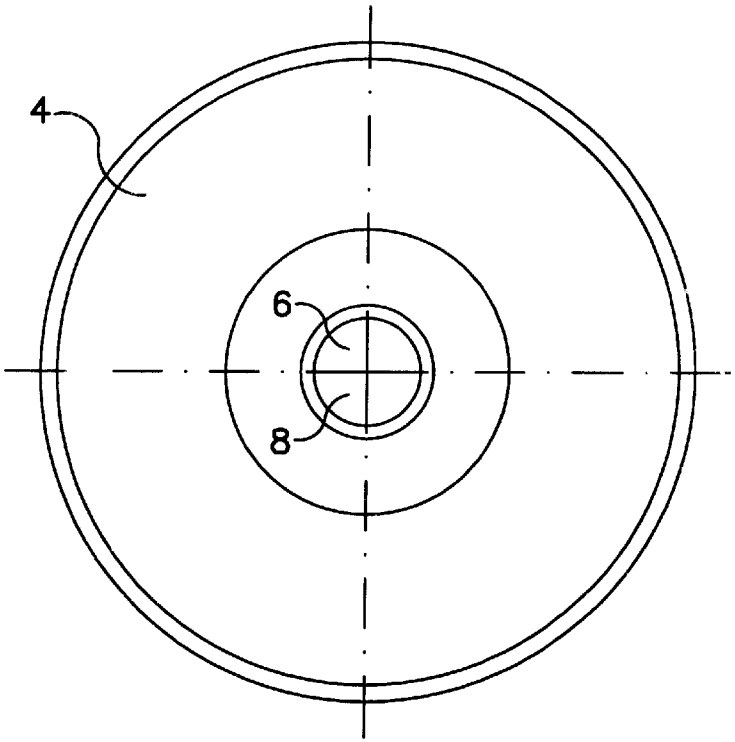

The present invention relates to a propellant charge module for artillery guns which is provided with a specially designed initiating charge.

The propellant charge module is of the type which consists of a predetermined quantity of propellant powder enclosed in a preferably rigid cylindrical container made of a combustible material, outwardly delimited by an outer cylinder wall adapted to the calibre dimensions of the relevant artillery gun, two essentially plane and parallel gable walls defining its ends, and a centrally arranged inner cylinder wall which extends axially through the propellant charge module and in turn defines a central ignition channel delimited from the propellant powder and which is itself made of a pyrophoric, i.e. easily combustible, material.

Propellant charge modules of this type are primarily to be regarded as unit charges since, almost without exception, several of them are used together to form propellant powder charges of a charge strength adapted for each range of fire. A general designation for these propellant charge modules or unit charges is "modular charges".

A common feature of the modular charges is that they have an external diameter specific for each weapon and that they all have the abovementioned central axial ignition channel which, when several modular charges are arranged in succession, for adaptation to a predetermined longer range of fire, will form a common and continuous ignition channel through all the modular charges included therein. However, the modular charges can have different lengths and contain different types and quantities of powder and can thus be of a different charge strength. Among the advantages of these propellant charge modules that may be mentioned, they are easy to combine into propellant charges of different charge strength and are thus easily adapted to different ranges of fire, and, by virtue so their rigid configuration, they are simple to automatically load, something which was not true of the soft, so-called bag charges, which they have been developed to replace.

In the case of propellant charges consisting of a plurality of propellant charge modules of the modular charge type, in order to achieve an instant flash-over along the entire central ignition channel common to all the propellant charge modules, it has already been proposed to arrange special firing charges inside these ignition channels. Some earlier variants of such firing charges have consisted of continuous powder tubes or a number of powder rings bearing tightly against one another. The most common material in these older firing charges has been conventional black powder.

Older variants of propellant charge modules of the modular charge type in question here are described in more detail in U.S. Pat. Nos. 4,702,167, 4,864,932, 4,922,823 and WO 89/04453.

As has already been mentioned, the present invention relates to a propellant charge module for artillery guns of the modular charge type which has been provided with a specially designed initiating charge.

The problem which it has been possible to solve by means of the present invention is that of being able to eliminate the tendencies towards uneven initiation of the propellant powder, principally in those propellant powder charges which consist of a plurality of unit charge modules arranged one after another in a row, and which in earlier variants of firing systems often gave rise to turbulent internal ballistics and hazardous pendulum pressures in the launching barrels.

The present invention thus relates, in summary, to a propellant charge module for artillery guns, comprising a predetermined quantity of propellant powder enclosed in a preferably rigid cylindrical container made of a combustible material, outwardly delimited by an outer cylinder wall adapted to the calibre dimensions of the relevant artillery gun, two essentially plane gable walls defining its ends, and a centrally arranged inner cylinder wall which extends axially through the propellant charge module. This inner cylinder wall in turn defines a central ignition channel which is delimited from the propellant powder and whose boundary wall is made up of a preferably cylindrical relay tube of pyrophoric, i.e. easily inflammable material. Arranged inside the ignition channel, in the central part thereof, as seen in its longitudinal direction, at an equal distance from the ends of the charge, there is also a firing charge in the form of a number of firing charge rings which are arranged one after the other in succession and bear against one another. Their external dimensions match the internal dimensions of the relay tube, while their internal dimensions form a common inner ignition channel.

A distinguishing feature of the invention is now, principally, that the firing charge rings which together form the complete firing charge have, at their gable ends directed towards each other, distancing members in the form of bosses, nibs or radial waves made in one piece with, and of the same material as, the firing charge rings themselves. These distancing members have a small height and provide very narrow gaps of preferably 0.5–2 mm between the different firing charge rings, but this is quite sufficient to afford a number of ignition gaps in towards the abovementioned relay tube, from which the flash-over, as soon as it has burnt through, spreads to the propellant powder charges in each propellant charge module. Practical tests have shown that the quicker flash-over obtained in this way means that the turbulent internal ballistics often occurring in earlier initiating systems, and the consequent pendulum pressures, have been able to be more or less completely eliminated. With this type of firing charge, it is ensured that the firing of the propellant powder in the main charge always takes place via the central channel, which in turn makes it possible to use the same charges in similar guns, even if these have slightly different chamber dimensions. The initiating is thus so quick that a flash-over from outside never has time to take place, even if there were a sufficient gap between the chamber wall and the propellant charge so that this could theoretically have happened.

In a further development of the invention, the relay tube surrounding the firing charge, and delimiting the space intended for the actual propellant powder charge from the central ignition channel, is provided with a number of through-slots or holes in order to accelerate the actual burning-through.

The invention also includes the variant in which the central firing ring of the firing charge is replaced by a firing pill which is made of the same or equivalent material and which differs from the firing rings in that it completely lacks the centre holes which these have. However, it has proven advantageous if this firing pill has its smallest material thickness in line with the centre axis of the ignition channel. The variant with ignition pill is especially suitable for initiating with laser, which will probably become more and more common since one is then no longer dependent on initiating cartridges for firing the actual artillery gun.

In addition, the relay tube will preferably consist of at least 70% nitrocellulose while the firing charge, i.e. the firing rings and the alternative firing pill, will expediently consist of a pyrotechnic charge which is prepared by wet mixing and which includes 60–70% potassium nitrate, 20–30% boron and 10–15% zinc stearate and, finally, 4–10% of an acrylic binder.

Figure 1:
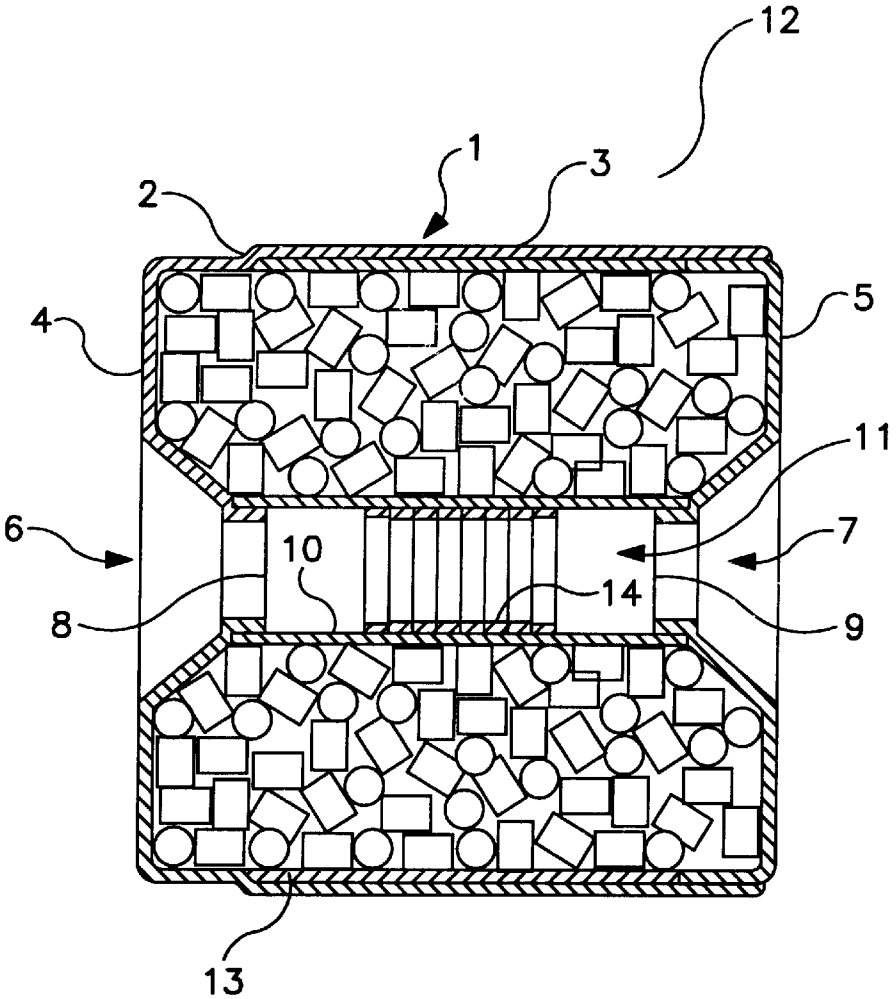
Figure 4:
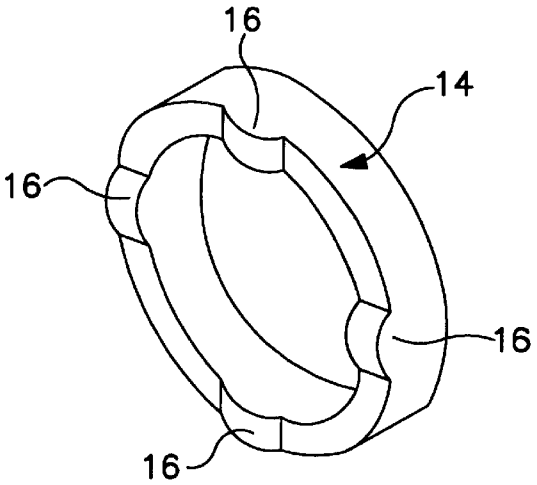
Figure 6:
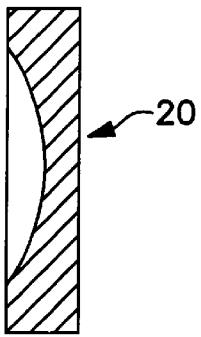
Figure 3:
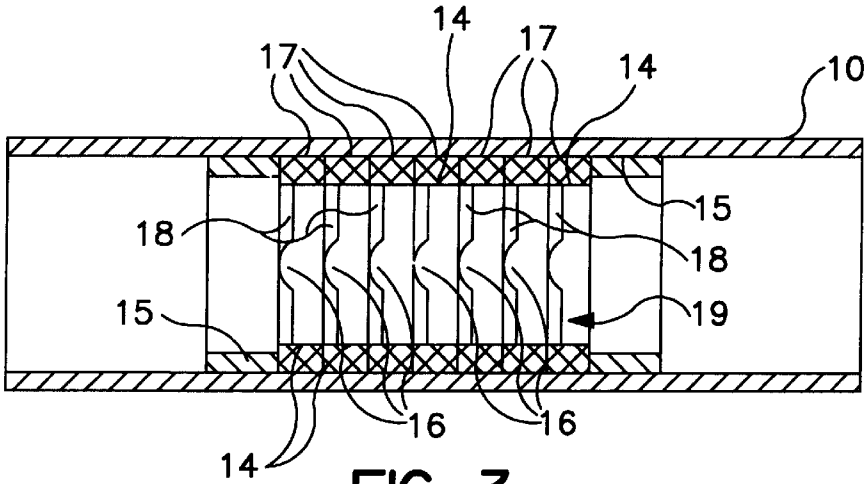
Figure 5:
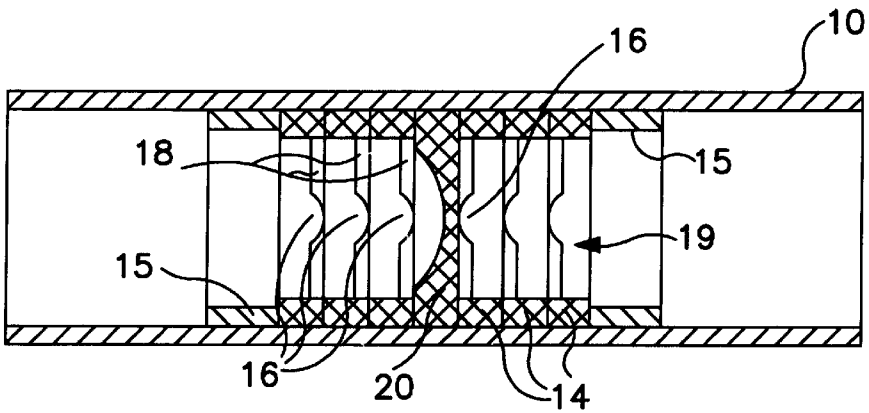

The invention is defined in more detail in the attached patent claims, and it will now be described further with reference to the attached figures, in which:

FIG. 1 shows a longitudinal section through a propellant charge module of the type in question here, FIG. 2 shows an end projection of the same propellant charge module, FIG. 3 shows a longitudinal section through the firing charge and the surrounding relay tube in the propellant charge module according to FIGS. 1 and 2, FIG. 4 shows an oblique projection of one of the firing rings included in the firing charge, FIG. 5 shows a variant of the arrangement according to FIG. 3, and FIG. 6 shows a section through the ignition pill included in the arrangement according to FIG. 5.

The various figures are drawn on different scales, partly for reasons of clarity, but where the same details appear in several figures, these have been given the same reference numbers in all of these figures.

The complete propellant charge module, generally designated by 1, comprises a combustible two-part outer casing in the form of a main part 2, including a cylindrical outer wall 3, and a more or less plane gable wall 4 formed in one piece with the latter, as well as a second cover part 5 designed as a second gable wall. Ignition channel openings 6 and 7 are arranged in the centres of the gable walls 4 and 5, respectively. In the example shown, the ignition channel openings are slightly conical and they are covered by easily burned-through protective foils 8 and 9, respectively. Running between the ignition channel openings 6 and 7 there is a preferably cylindrical relay tube 10 whose interior forms an ignition channel 11 running through the entire propellant charge module. The space between the outer wall, the gable walls and the relay tube is filled with a preferably multiply granulated artillery propellant powder 12. The relay tube 10, which can for the most part consist, for example, of nitrocellulose, has the purpose, as soon as it has burned through to the artillery propellant powder 12, of spreading an initiation effected inside the ignition channel 11. Anti-wear agents, for example of the Swedish Additive type, and flame dampers or other additives can be arranged along the inside of the outer wall 3. In FIG. 1, these additives have been designated generally by 13.

The initiating system which distinguishes the invention can be of two basic types illustrated in FIGS. 3, 4 and FIGS. 5, 6 respectively. In accordance with both variants, a number of firing rings 14 made of pyrotechnic material are arranged in the relay tube 10. These are held in place inside the relay tube 10 by combustible gable rings 15. The empty central portions of the firing rings together form an inner initiating channel 19. A distinguishing feature of these firing rings is also that these have, at least at one gable end, distancing members 16 in the form of nibs, bosses or wave formations in their own end surface. These distancing members, which are preferably made in one piece with, and of the same material as, the rest of the firing rings, have the object of ensuring that there are flash-over gaps 18 between the firing rings. This is to accelerate the flash-over of the actual propellant charge and thereby eliminate the risks of turbulent internal ballistics and the associated pendulum pressure in the launching barrel in connection with firing. As a complement to these flash-over gaps 18, the relay tube 10 can also be provided with a number of smaller through-openings or holes or alternatively slits. In FIG. 3, these have been generally designated by 17.

The variant shown in FIGS. 5 and 6 differs from that according to FIGS. 3 and 4 principally in that the central firing ring has been replaced by a firing pill 20. This therefore lacks the central channel 19 of the firing rings, but it nevertheless has a slightly smaller material thickness at the centre 21. By turning all the bosses of the firing rings in towards the firing pill 20, it is possible to ensure that an ignition gap is formed on both sides of the ignition pill. In FIG. 5 there are no holes or slits shown in the relay tube 10, but this does not mean that these cannot be present in this variant too. The variant with a firing pill 20 at the centre of the firing charge is specially suited for use in those artillery guns which use laser for initiating the propellant powder charges instead of the ignition cartridges which are more common at present.

What is claimed is:

1. Propellant charge module (1) for artillery guns, comprising a predetermined quantity of propellant powder (12) enclosed in a preferably rigid cylindrical container (1) made of a combustible material, outwardly delimited by an outer cylinder wall (3) adapted to the calibre dimensions of the artillery gun, two essentially plane gable walls (4, 5) defining its ends, and a centrally arranged inner cylinder wall (10) which extends axially through the propellant charge module (1) and in turn defines a central ignition channel (11) which is delimited from the propellant powder and whose boundary wall is made up of a relay tube (10) of pyrophoric material, in at least the central part of which, as seen in the longitudinal direction, at an equal distance from the ends of the relay tube (10), there is arranged a firing charge in the form of a number of firing charge rings (14) which are arranged in succession one after the other, bear against one another and are made of a pyrotechnic material, and whose external dimensions match the internal dimensions of the relay tube (10) and whose internal dimensions form a common inner ignition channel (19), characterized in that the firing charge rings (14) together forming the firing charge have, at their gable ends directed towards each other, distancing members (16) which define ignition gaps between them.

2. Propellant charge module (1) for artillery guns according to claim 1, characterized in that the distancing members (16) which define the ignition gaps between the firing charge rings (14) are made of the same material as the rest of the rings (14).

3. Propellant charge module for artillery guns according to claim 2, characterized in that the distancing members (16) of the firing charge rings (14) have the form of bosses or nibs which are distributed across at least one of two gable ends of firing charge rings (14) bearing against each other.

4. Propellant charge module (1) for artillery guns according to claim 1, characterized in that a firing charge pill (20) which is of the same material as the firing charge rings (14), and which fully screens off the ignition channel (19), is arranged between the two middle firing charge rings (14) in the respective firing charge.

5. Propellant charge module for artillery guns according to claim 1, characterized in that the relay tube (10) defining the ignition channel (11) has a number of holes (17), slits or equivalent which provide a quicker flash-over in towards the propellant powder (12).

6. Propellant charge module (1) for artillery guns according to claim 1, characterized in that the relay tube (10) is made at least 70% of nitro-cellulose.

7. Propellant charge module (1) for artillery guns, characterized in that the different parts of the firing charge consist of a composition which is prepared by wet mixing and which includes potassium nitrate, boron, zinc stearate and acrylic binder.

8. Propellant charge module (1) for artillery guns according to claim 1, characterized in that several different types of modules with different properties are included in a complete propellant charge.

* * * * *